US008783507B2

(12) United States Patent
Schaefers

(10) Patent No.: US 8,783,507 B2
(45) Date of Patent: Jul. 22, 2014

(54) NAPKIN DISPENSER

(76) Inventor: James A. Schaefers, Tinley Park, IL (US)

( * ) Notice: Subject to any disclaimer, the term of this patent is extended or adjusted under 35 U.S.C. 154(b) by 12 days.

(21) Appl. No.: 12/931,580

(22) Filed: Feb. 3, 2011

(65) Prior Publication Data

US 2011/0163111 A1 Jul. 7, 2011

Related U.S. Application Data

(63) Continuation-in-part of application No. 12/804,760, filed on Jul. 28, 2010, now abandoned, and a continuation-in-part of application No. 11/513,533, filed on Aug. 31, 2006, now Pat. No. 7,766,187.

(51) Int. Cl.
*B65H 1/08* (2006.01)

(52) U.S. Cl.
USPC ..... 221/56

(58) Field of Classification Search
USPC ..... 221/56, 198, 312 A, 52
See application file for complete search history.

(56) References Cited

U.S. PATENT DOCUMENTS

| | | | | |
|---|---|---|---|---|
| 1,563,078 | A * | 11/1925 | Erdos | 221/45 |
| 1,703,594 | A * | 2/1929 | Pratt | 221/23 |
| 1,874,642 | A * | 8/1932 | Shaffer et al. | 221/47 |
| 1,938,025 | A * | 12/1933 | Kelly | 221/55 |
| 7,178,689 | B2 * | 2/2007 | Wieser et al. | 221/52 |

* cited by examiner

*Primary Examiner* — Timothy Waggoner
(74) *Attorney, Agent, or Firm* — Anne M. Burkhart; Excellere IP International

(57) ABSTRACT

An improved napkin device is set forth. The device includes a front face adapted for opening to load napkins therein. A first downwardly angled steel rod is fixed to a first side face, and a second downwardly angled steel rod is fixed to a second side face. Each of the steel rods has a substantially circular cross section. A plate adapted to slide along the first and second steel rods until it reaches a stop, disposed perpendicular to the first and second side faces of the device is provided. The stop is connected to the first and second side faces. The plate comes to rest at the stop as it slides along the first and second steel rods.

9 Claims, 3 Drawing Sheets

NAPKIN DISPENSER

CROSS REFERENCE TO RELATED APPLICATIONS

This application is a Continuation-in-Part of U.S. patent application Ser. No. 12/804,760 filed 28 Jul. 2010 now abandoned entitled "IMPROVED NAPKIN DISPENSER" and U.S. patent application Ser. No. 11/513,533 filed 31 Aug. 2006, now U.S. Pat. No. 7,766,187 entitled "A NAPKIN DISPENSER", incorporated herein by reference.

BACKGROUND

1. Technical Field

This invention relates to an improved napkin dispenser, and more particularly, to a front loading gravity fed napkin dispenser.

2. Description of the Related Art

Dispensing machines for maintaining articles in a clean and orderly array have been developed for dispensing articles one at a time. Such a dispenser is discussed, for example, in U.S. Pat. No. 4,473,172 to Reynolds.

The Reynolds dispenser permits articles held in a vertical plane, such as newspapers, magazines, and the like, to be viewed through a transparent front glass. The dispenser is designed to be theft-proof.

U.S. Pat. No. 1,874,642 to Shaffer et al. discusses a napkin dispenser having rectangular ribs extending along inner sidewalls, and a plate adapted with rectangular notches adapted to slide along the ribs.

SUMMARY OF THE INVENTION

An improved napkin dispenser is set forth. The dispenser includes a front face having a substantially centrally located opening adapted to fit napkins pulled therethrough. A back face connecting two side faces to the front face is provided. At least one downwardly angled steel rod having a substantially circular cross-section is connected in to each of the two side faces. A plate having protruding members, either slots or a notches extending therefrom is also provided. The location of the protruding members corresponds to the location of the steel rod. The plate moves toward the front face by sliding the protruding members along the steel rod until a stop is reached.

DESCRIPTION

Figure 1:
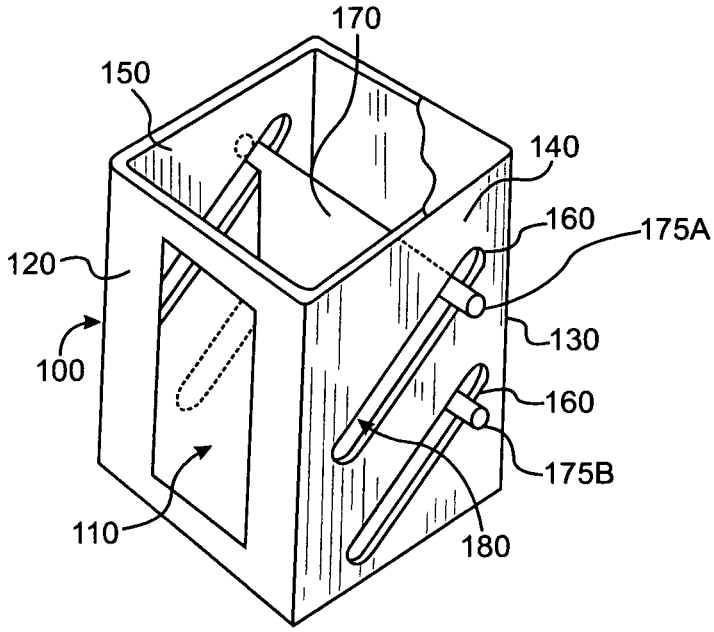
FIG. 1 illustrates an embodiment of an improved napkin dispenser constructed in accordance with the principles herein, wherein a perspective view, partially broken away, illustrates a plate of the dispenser fitted in slots provided therein.

As illustrated in FIG. 1 an exemplary embodiment of an improved napkin dispenser shown generally at 100 is constructed in accordance with the principles herein. The napkin dispenser is of a suitable size and dimension to accommodate the storage in an interior via an opening 110 of multiple napkins. Typically, napkin sizes vary only small napkins, typically used in conjunction with drinks or cups, to large dinner napkins, which are typically multilayered and prefolded. The napkin dispenser, or device 100 includes a front face 120 having the substantially centrally located opening 110 adapted to fit napkins pulled therethrough.

A back face 130 is provided. The back face 130 connects two side faces, such as side face 140 and an opposing side face 150, to the front face 120. Slots 160 are provided, for example, on side face 140. The slots 160 can be arranged, for example in a pair of substantially parallel, downwardly angled slots 160 formed in a parallel and opposing configuration in each of the two side faces, such as side face 140 and side face 150.

A plate 170 is provided. The plate 170 can be formed of any suitable material, such as sheet metal, metal plate, plastic, or any other suitable material. The plate 170 includes a set of opposed outwardly extending, protruding members 175A and 175B extending through openings 180 in slots 160, for example. The plate 170 moves toward the front face 120 by sliding the protruding members 175A and 175B in the substantially parallel slots 160.

Figure 2:
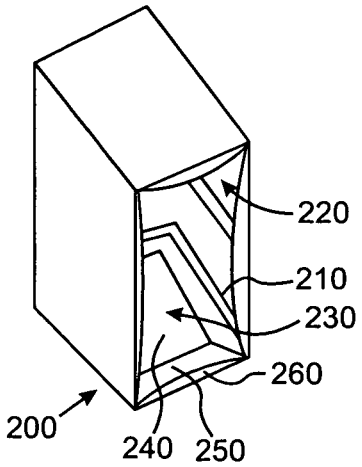
FIG. 2 illustrates a perspective view of an embodiment constructed in accordance with the principles of the present invention, wherein bent steel rods having substantially circular cross section are provided on an inside face therein, and wherein the floor is bent to provide a stop.

In another embodiment illustrated in FIG. 2, an improved napkin dispenser, shown generally at 200 can include, for example, at least one steel rod 210, having a substantially circular cross section, fixed to an interior wall 220 of the dispenser 200. In this embodiment, a bottom 230 of the dispenser 200 can include an upwardly angled section 240 and a stop section 250 provided adjacent a front face 260 of the dispenser 200.

Figure 3:
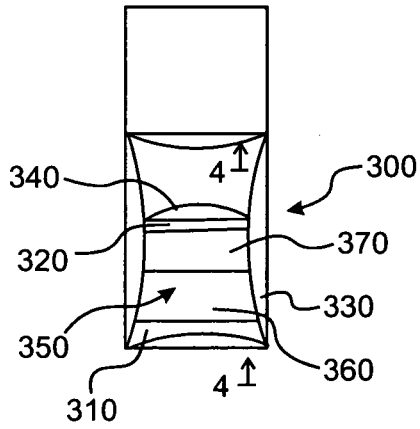
FIG. 3 illustrates a front angled perspective view of an embodiment of an improved napkin dispenser constructed in accordance with the principles herein, wherein a stop is provided near a front face and a second stop is provided near an open back face thereof.

As illustrated in an embodiment of FIG. 3, a dispenser shown generally at 300 can include a front stop 310 and a back stop 320, such that napkins can be dispensed from both a front face 330 and a back face 340 thereof. In this embodiment, an angled bottom 350 includes an upwardly angled front section 360 and an upwardly angled back section 370, and at least on steel (not shown) can be fixed to a sidewall of the dispenser.

Figure 4:
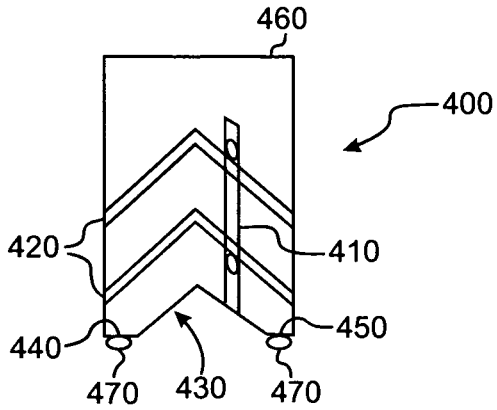
FIG. 4 illustrates a view along lines IV-IV of FIG. 3, wherein a plate having outward protrusions, or slots, is provided along a sidewall of the device.
Figure 5:
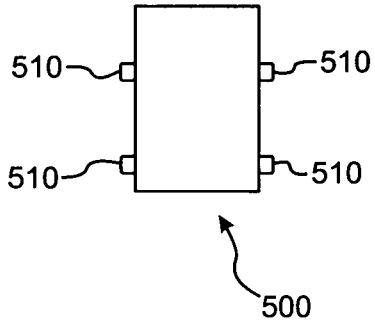
FIG. 5 illustrates a front view of the plate of FIG. 4.

A suitable plate, such as plate 410, illustrated in FIG. 4, can be provided along a pair of bent steel rods 420 provided along an interior sidewall of one embodiment of a dispenser 400 constructed in accordance with the principles herein. A bottom floor shown generally at 430, includes a front stop 440 and a rear stop 450 formed parallel to a top 460 of the dispenser 400. Rubber feet 470 can be attached to the dispenser 400 in a suitable manner, such as by welding or gluing, along a lower side of the front stop 440 and the rear stop 450. The plate 410 is adapted to slide downwardly along the rods 420 until the plate reached either the front stop 440 or the rear stop 450. A suitable plate can include, for example, a plate having outward protrusions 510, such as plate 500 of FIG. 5, or a plate having downwardly angled notches 610, as illustrated in the embodiment of a plate 600 adapted and constructed to slide along an interior of a dispenser, such as dispenser 300.

Figure 7:
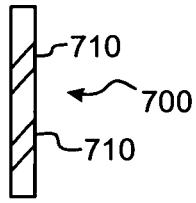
FIG. 7 illustrates a side view of the plate of FIG. 6.

As illustrated in FIG. 7, a side view of a plate shown generally at 700 illustrates a suitable exemplary angle for the downwardly angled notches 710 of a substantially circular cross section.

Figure 6:
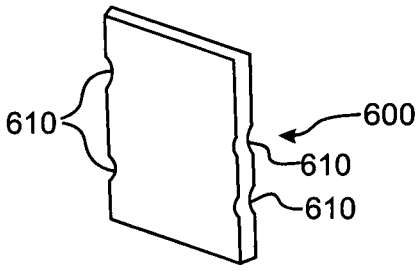
FIG. 6 illustrates a side perspective view of a plate constructed with downwardly angled notches therein.
Figure 8A:
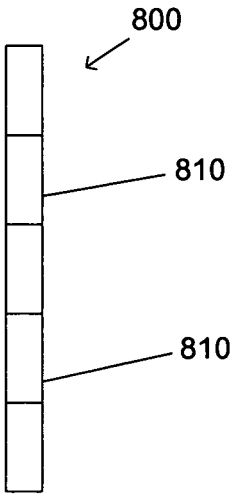
FIG. 8A-C illustrate another embodiment of a plate constructed in accordance with the principles herein.
Figure 8B:
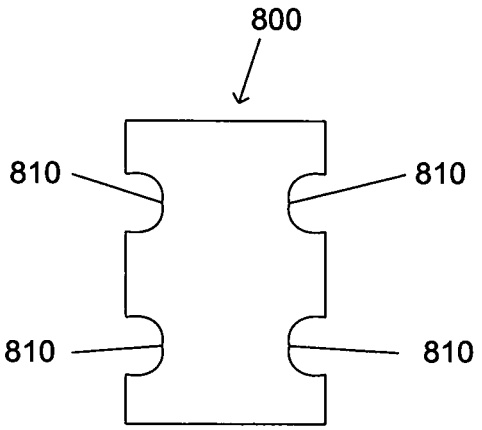
Figure 8C:
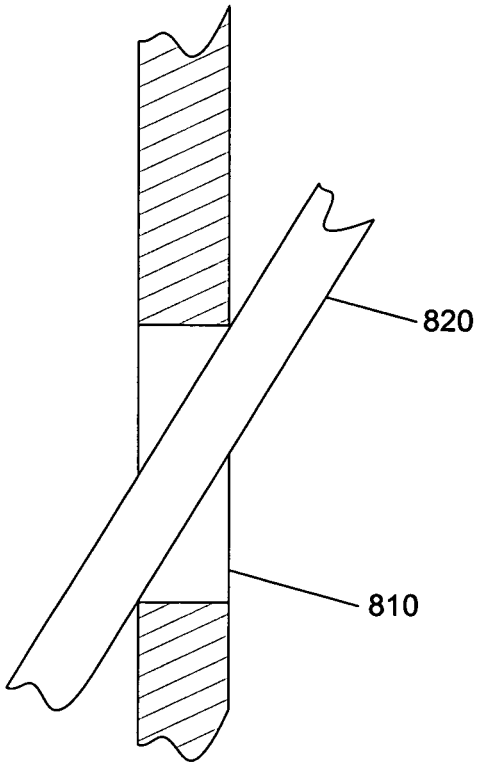

Alternatively, another embodiment of a plate can include notches of any suitable configuration, such as, for example, semi-circular notches 810 formed in a plate shown generally at 800 illustrated in FIGS. 8A, 8B and 8C. The notches 810 can be formed in any suitable shape, wherein the notches 810 are formed to exceed the size of the one or more slides, such as slide 820 formed of a suitable material, such as, for example, bent steel rods, or any other suitable material as depicted in the cut away view of FIG. 8C. In this example, the notches 810 are substantially perpendicular to the plate 800, and the downward angles of the notches 610, 710 shown in FIGS. 6 and 7 are not required due to the increased size of the notches 810 relative to the slide 820. All material employed to form a suitable dispenser in accordance with the principles herein can be interchanged with any suitable alternative materials, such as plastic, wood, other metals or any other suitable materials for cost benefits or aesthetic reasons.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim as my invention:

1. An improved napkin dispenser comprising:

a front face having a substantially centrally located opening adapted to fit napkins pulled therethrough;

a back face connecting two side faces to the front face;

at least one steel rod having a substantially circular cross section, downwardly angled along an inside wall of a side of the dispenser;

a vertical plate, formed of a sheet of material having a substantially similar size and configuration as a conventional napkin, having protruding members adapted to slide along the steel rod; and wherein the vertical plate moves toward the front face by sliding the protruding members in substantially parallel slots and stops when it reaches a stop section provided on a bottom of the dispenser, wherein a front of the stop section where the vertical plates stops is substantially perpendicular to the plate and to the two side faces of the dispenser and is adjacent to and spaced from the front face.

2. An improved napkin device as claimed in claim 1, further comprising an upwardly sloped bottom connected to the stop section.

3. An improved napkin device as claimed in claim 2, further an opening provided in a back face of the dispenser for dispensing napkins therefrom.

4. An improved napkin device as claimed in claim 1, wherein the protruding members are further defined by downwardly extending angled notches having a substantially semi-circular cross section.

5. An improved napkin device comprising:

a front face adapted for opening to load napkins therein;

a first downwardly angled steel rod fixed to a first side face, and a second downwardly angled steel rod fixed to a second side face, each of the steel rods having a substantially circular cross section;

a vertical plate adapted to slide along the first and second steel rods; and a horizontal stop section, disposed perpendicular to the plate and to the first and second side faces and connected thereto, for stopping the plate as it slides along the first and second steel rods before reaching the front face.

6. An improved napkin device as claimed in claim 5, further comprising: a sloped floor connected to the stop section of the device.

7. An improved napkin device as claimed in claim 6, further comprising: third and fourth steel rods provided along the first and second side faces, respectively, and adapted to slide the plate thereon.

8. An improved napkin device as claimed in claim 7, wherein the third and fourth steel rods have a substantially semi-circular cross-section.

9. An improved napkin device comprising:

a first downwardly angled steel rod fixed to a first side face, and a second downwardly angled steel rod fixed to a second side face;

a vertical plate adapted to slide along the first and second steel rods; and a horizontal stop section connected to the first and second side faces and disposed substantially perpendicular to the plate and to the first and second side faces, for stopping the plate as it slides along the first and second steel rods before reaching a front face of the napkin device.

* * * * *